US005159880A

United States Patent [19]

Mugnier

[11] Patent Number: 5,159,880

[45] Date of Patent: Nov. 3, 1992

[54] CABLE TRANSPORT INSTALLATION WITH CARS DRIVEN BY FRICTION

[75] Inventor: Jean-Francois Mugnier, Fontaine, France

[73] Assignee: Pomagalski S.A., Fontaine, France

[21] Appl. No.: 631,861

[22] Filed: Dec. 21, 1990

[30] Foreign Application Priority Data

Nov. 15, 1990 [FR] France ..... 90 14677

[51] Int. Cl.[5] ..... B61B 13/00

[52] U.S. Cl. ..... 104/87; 104/168; 198/787

[58] Field of Search ..... 104/87, 165, 168, 173.1, 104/173.2; 198/787

[56] References Cited

U.S. PATENT DOCUMENTS

| | | | |
|---|---|---|---|
| 491,746 | 2/1893 | Storle | 198/787 X |
| 731,292 | 6/1903 | Dunwald | 104/168 X |
| 2,622,720 | 11/1952 | Lorig | 198/787 |
| 3,026,993 | 3/1962 | Penn | 198/787 |
| 3,412,690 | 11/1968 | Broggie et al. | 104/168 |
| 3,724,643 | 4/1973 | Kohl | 198/787 |
| 4,744,306 | 5/1988 | Kunczynski | 104/168 |
| 4,794,864 | 1/1989 | Feuz et al. | 104/168 |

FOREIGN PATENT DOCUMENTS

| | | | |
|---|---|---|---|
| 0355084 | 7/1989 | European Pat. Off. . | |
| 2716022 | 10/1978 | Fed. Rep. of Germany | 198/787 |
| 27183 | 3/1977 | Japan | 104/168 |
| 1070093 | 1/1984 | U.S.S.R. | 198/787 |

*Primary Examiner*—Margaret A. Focarino
*Assistant Examiner*—Joseph D. Pape
*Attorney, Agent, or Firm*—Parkhurst, Wendel & Rossi

[57] ABSTRACT

In the by-pass zone of a car transfer track, in a terminal station of a detachable gondola lift or chairlift, the cars are driven by tired wheels. Transmission between two successive wheels comprises two toothed bevel pinions, wedged onto the wheel spindles, which engage with an inverter bevel pinion inserted between adjacent toothed benel pinions.

7 Claims, 3 Drawing Sheets

CABLE TRANSPORT INSTALLATION WITH CARS DRIVEN BY FRICTION

BACKGROUND OF THE INVENTION

The invention relates to a gondola lift or chairlift with cars detachable from the cable in the stations comprising a transfer track on which the cars run being driven by friction by tired wheel trains, spaced along the track, each wheel being rotatably mounted on a horizontal spindle or axis perpendicular to the track and being driven in rotation.

In stations of the detachable gondola lifts or chairlifts, hereafter called chairlifts, the cars, in this instance chairs, are driven by chains with push fingers or tired friction wheels, spaced along the track. The friction wheels are very flexible and enable driving at variable speeds for braking or acceleration of the cars. The movement, derived from the cable or from a motor, is generally transmitted from one wheel to the other by belts and pulleys, wedged onto the wheel spindles. In the curves of the transfer track, notably in the by-pass zone, the wheel spindles are arranged perpendicularly to the curved track and are therefore no longer perfectly parallel. This results in wear of the belts and notable losses of power. By lengthening the belts and providing return pulleys, alignment defaults of these pulleys can be at least partially compensated, but transmission is more complicated.

The object of the present invention is to achieve an efficient transmission from one wheel to the other in the by-pass zone by simple means.

SUMMARY OF THE INVENTION

The chairlift according to the invention is characterized in that in the by-pass zone of the track, the driving force is transmitted from one wheel to an adjacent wheel by a cog-wheel transmission which tolerates the angle formed between the spindles of the two wheels.

Cog-wheel transmission between non-parallel spindles is state-of-the-art, in particular toothed bevel pinion gear and, according to the invention, an inverter pinion is fitted between the two pinions wedged onto the spindles of the friction wheels to keep the rotation direction of the successive wheels. The three pinions of a cog-wheel transmission from one friction wheel to the other are preferably identical and their spindles extend in the same plane. The same toothed pinion, wedged onto the friction wheel spindle, receives the movement of the previous wheel and transmits it to the next wheel. The use of pinions made of plastic material reduces noise and lubrication problems.

It is important to standardize the drive systems and according to a development of the invention, the friction wheel spindles, which support the drive toothed pinions and the inverter pinion spindles are each mounted in a standard bearing box and these bearing boxes are fixed to a girder which follows the trajectory of the by-pass track. By providing adjustable fixing, precise positioning of the bearing boxes can be obtained by inserting between the toothed pinions a film, whose thickness corresponds to the clearance necessary for correct operation. The bearing box of a friction wheel supports on one side the friction wheel and on the other side the toothed wheel, whereas an inverter pinion box only supports the inverter pinion. The cog-wheel transmission is located on the inside of the curve. The size of the pinions obviously depends on the distance between the spindles and should the need arise, an inverter pinion smaller or larger than the drive pinions can be used.

Cog-wheel transmission is also suitable for the straight sections, but it is unsuitable for speed variations, in particular in the acceleration or braking zones of the chairs. Cog-wheel drive systems can easily be combined with belt systems by fitting, for example, on the spindle of the first by-pass zone wheel, in addition to the toothed pinion, a pulley receiving the movement of the previous wheel of the straight zone by means of a belt. Switching from one transmission mode to the other is therefore simple and easy to achieve.

Driving by cog-wheels is naturally well-suited to friction wheels of a rhythm device, whose second drive mode may be of any kind, notably a chain with push fingers.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 4:
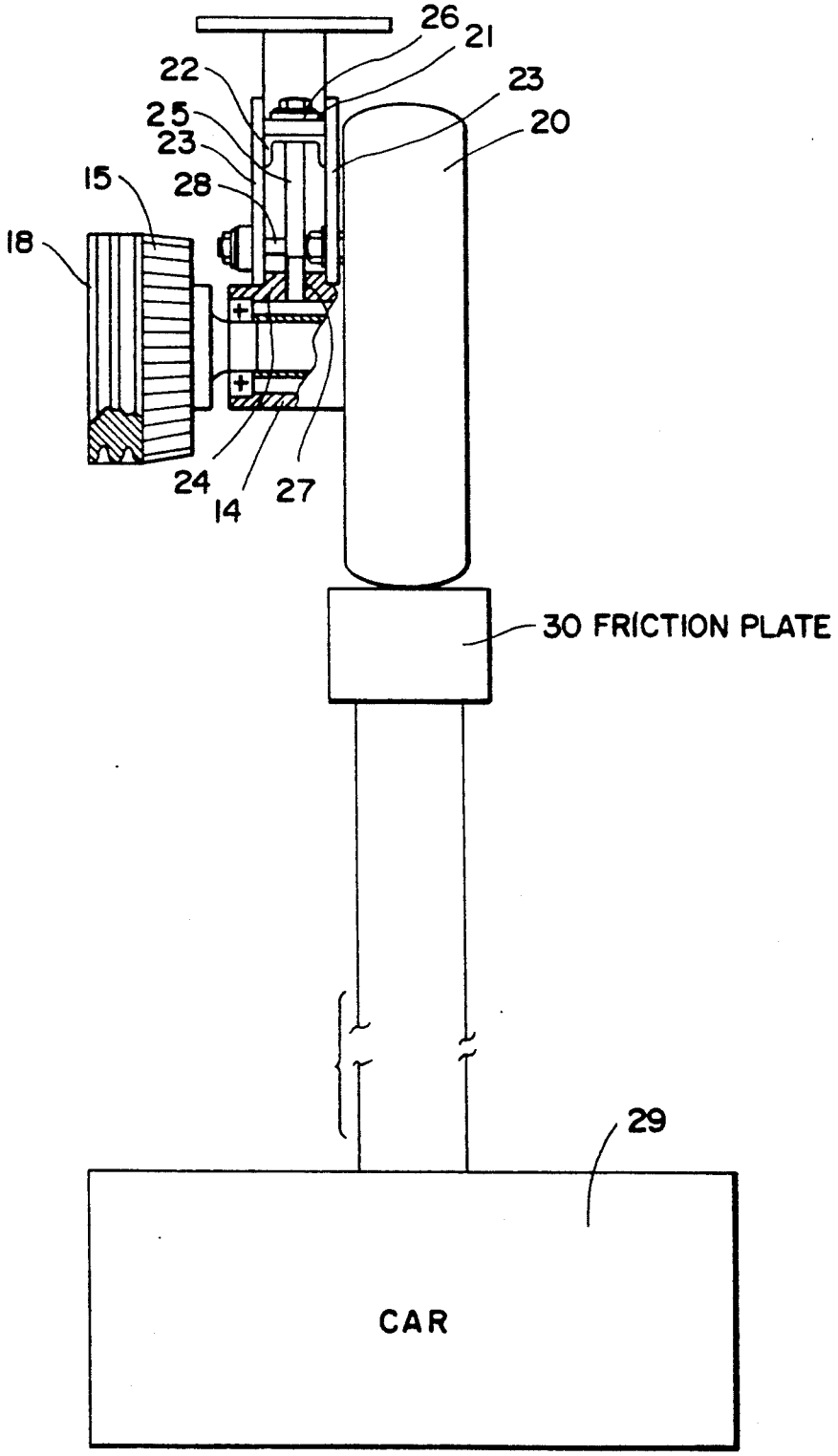
FIG. 4 is an elevational view showing the driving engagement of a car along the transfer track of the present invention.

In the figures, transfer track 9 of a chairlift, for example, includes a curved section 10 and tired wheels 11, located at regular intervals along the track to cooperate by friction with a friction plate 30, supported by the support carriage of the chair or car 29 (FIG. 4). The curved section 10 succeeds a straight section 12, only the last two tired wheels of which are represented, which straight section 12 can comprise the braking zone of the chairs detached from the cable at the entrance to the station. In a symmetrical manner the semicircular curved section 10 of the by-pass track can be connected to a straight section, aligned with the exit strand of the cable and comprising the acceleration wheels. Detachable chairlifts of this kind are well-known and for example described in the French Patent application No. 9,005,309 of Apr. 24, 1990 filed by the applicant which corresponds to the copending U.S. patent application Ser. No. 07/631,963.

The tired friction wheels 11 are supported by spindles 13, each of which are rotatably mounted in a bearing box 14, fixed on a curved girder 21 which extends along the by-pass zone 10. The spindle or rotation axis 13 bears on the opposite end to the wheel 11 a toothed bevel pinion 15, which rotates with the wheel 11. All the bearing boxes 14 with the friction wheel 11 and toothed pinion 15 are identical and are spaced regularly along the track, so that the chair carriage is always in contact with at least one tired wheel 11 which provides its drive. Between two successive bearing boxes 14 of tired wheels 11 there is fitted a bearing box 16, which may be identical to the other bearing boxes 14, but does not support a tired wheel 11. The toothed pinion of the bearing box 16 is an inverter bevel pinion 17, which engages with the two adjacent drive pinions 15 to transmit the movement of a wheel 11 to the next wheel. The diameter of the toothed pinions 15, 17 is naturally chosen to suit the spacing of the wheels 11 and their conicity corresponds to the angle formed by the two successive rotation axes 13. The diameter of all the toothed pinions 15, 17 is preferably the same, but it is possible to use smaller or larger inverter pinions 17 and drive pinions 15 of different diameters, all combinations being possible. In the example represented in the figures, all the tired wheels 11 rotate at the same speed and in the same direction to move the chairs at constant speed in the by-pass zone 10.

In the straight section 12, transmission is preferably by means of pulleys 18 and belt 19, each spindle supporting two pulleys 18, one receiving and the other driving. The spindle of the transition tired wheel 20 from the straight section 12 to the curved section 10 supports a pulley 18, connected by a belt 19 to the adjacent pulley of the straight section 12 and a toothed pinion 15 engaging with the adjacent inverter pinion 17 of the curved section 10. Transmission of movement between the tired wheels is thus kept over the whole track in a particularly simple manner. Other transmission systems can naturally be used. The toothed pinions 15, 17 are made of suitable plastic material.

Figures 1, 2:
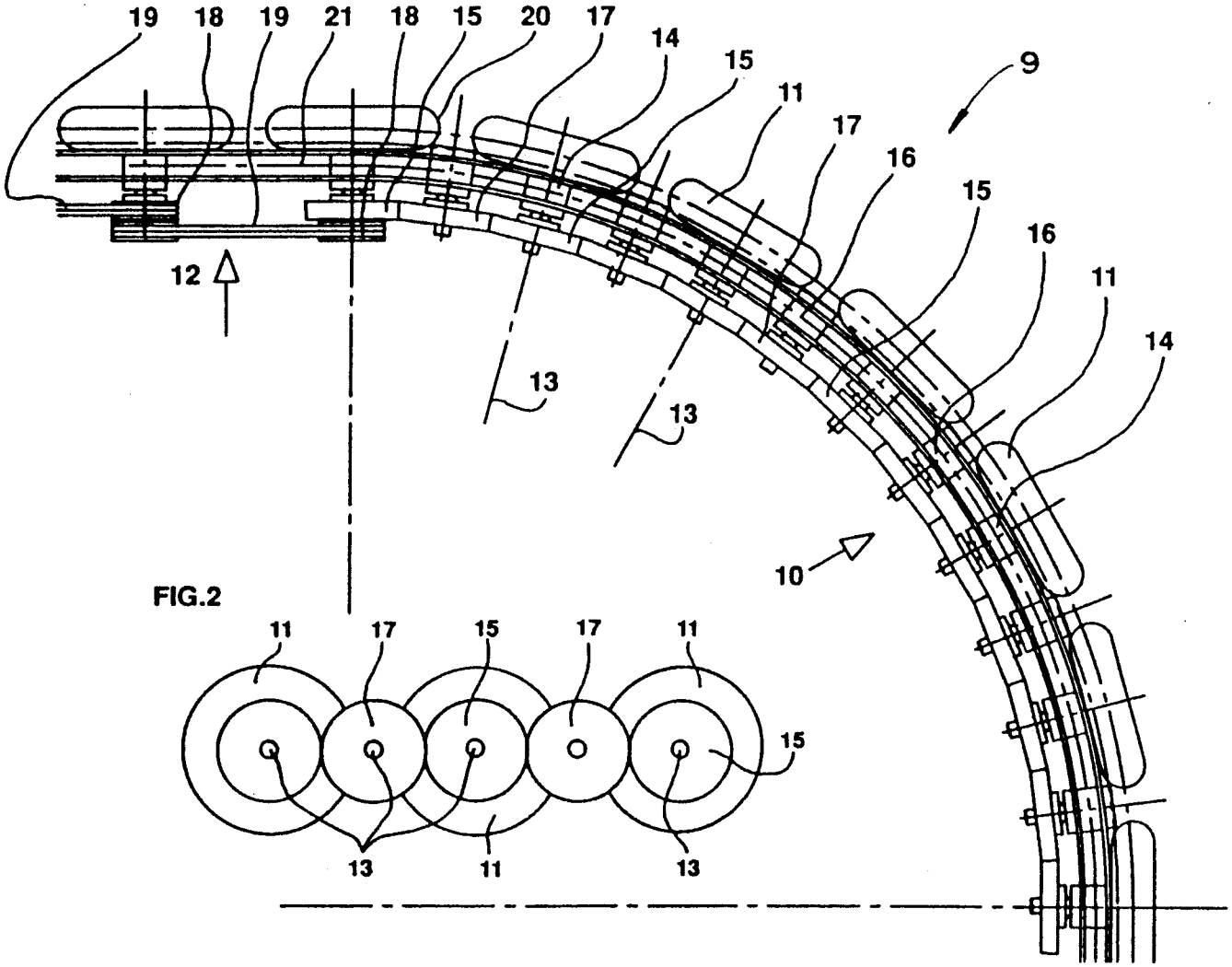
FIG. 1 is a schematic plane view of a cog-wheel driving device according to the invention.
FIG. 2 is a schematic elevational view of the cog-wheels according to FIG. 1.
Figure 3:
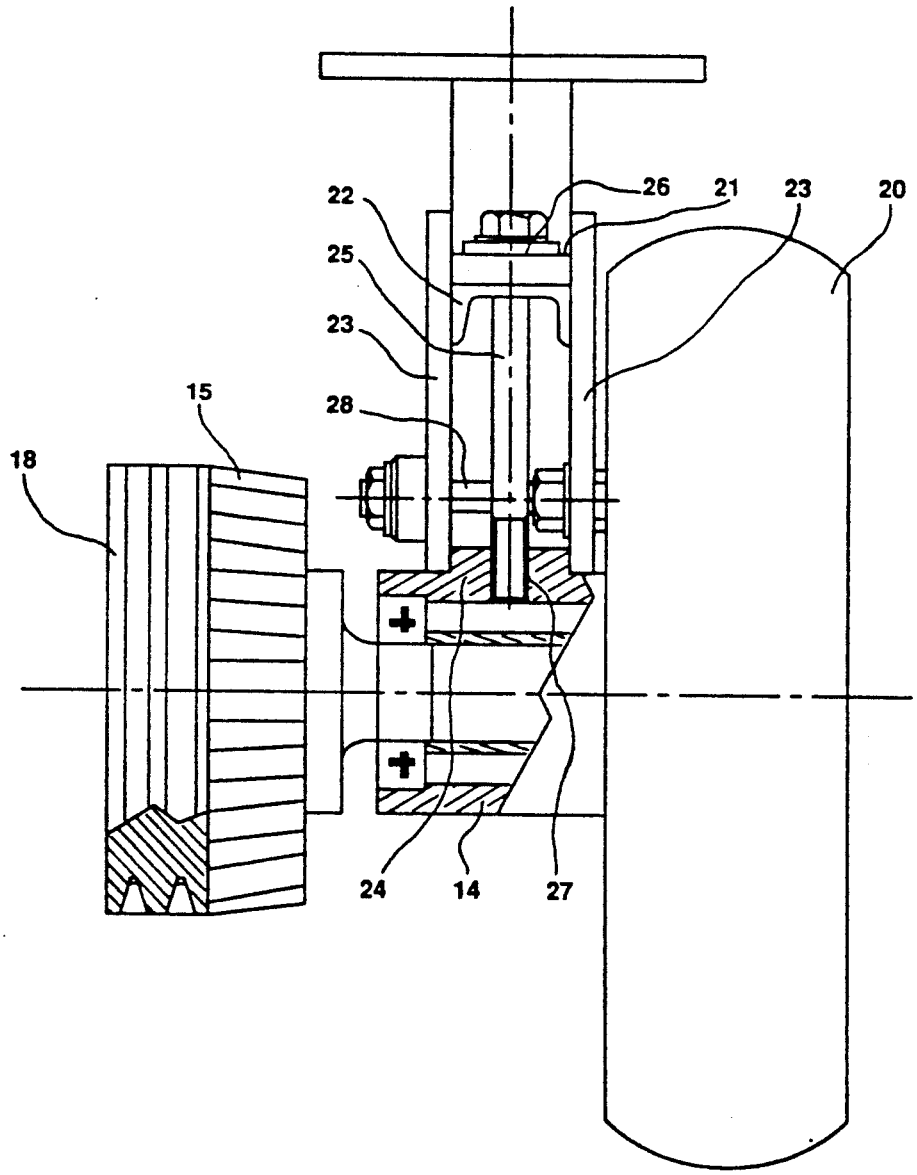
FIG. 3 is a partial sectional view of a bearing box.

Fixing the bearing boxes 14, 16 to the girder 21 requires a certain precision and according to the invention a possibility of adjustment when fitting is provided. Referring to FIG. 3, it can be seen that the girder 21 is formed by a U-shaped iron section 22, extended by two side flanges 23, between which a protrusion 24 of the bearing box 14, 16 engages. A vertical fixing screw 25 passes through an elongated orifice 26, arranged in the U-shaped iron section 22 and is screwed into a threaded orifice 27 of the bearing box 14, 16 to maintain the latter between the flanges 23. It can be understood that before the screw 25 is tightened, the bearing box 14, 16 can slide between the flanges 23 in the longitudinal direction of the girder 21 and within the limits of the fore and aft position of the toothed pinion 15 and thus the orifice 26 to adjust the clearance between the toothed pinions 15, 17. Adjustment is facilitated by inserting between the teeth of these pinions 15, 17 a thin film of a thickness corresponding to the clearance necessary for correct operation. After the fixing screw 25 has been adjusted and tightened, the assembly merely has to be secured by means of a bolt 28 connecting the flanges 23 in proximity to the box 14, 16. Other correct positioning modes are obviously conceivable.

Operation of the transmission by toothed gear is apparent from the above description and it is clear that it can also be used on the straight sections. The friction wheels can drive the chair carriages on their own or belong to a rhythm device, equipped with a second drive means, notably by chain with push fingers. The speed of the friction wheels can be variable and controled by a programer to make up for rhythm deviations and form a rhythm device according to the French Patent application No. 9,007,598 of Jun. 13, 1990 filed by the applicant. The drive can be derived from the movement of the cable or of the cable return pulley, the use of an independent motor naturally being possible. This French Patent application corresponds to the copending U.S. Pat. Ser. No. 07/631,466.

The invention also extends to cog-wheel transmissions using non-bevel pinions.

I claim:

1. A transfer track for frictionally driving cars therealong, comprising:

tired wheels disposed along said transfer track for frictionally driving said cars, each of said tired wheels having a respective rotation axis;

a cog-wheel transmission for driving said tired wheels disposed along said transfer track, said cog-wheel transmission comprising:

a) a plurality of toothed drive pinions, at least one of said toothed drive pinions being disposed on the rotation axis of each tired wheel; and b) a plurality of toothed inverter pinions, at least one of said toothed inverter pinions being disposed between adjacent toothed drive pinions for transmitting rotation to said toothed drive pinions, wherein said toothed drive pinions and said toothed inverter pinions are conical.

2. The transport lift of claim 1, wherein said toothed drive pinions and said toothed inverter pinions are substantially the same size thereby driving said tired wheels at a given rotational velocity, said rotational velocity being variable.

3. The transport lift of claim 1, further comprising a plurality of bearing boxes, each of said bearing boxes rotatably supporting one of said toothed drive pinions or one of said toothed inverter pinions.

4. The transport lift of claim 3, wherein said transfer track includes a curved portion wherein each of said tired wheels are disposed radially outwardly with respect to each of said bearing boxes, and wherein each of said toothed drive pinions and said toothed inverter pinions are disposed radially inwardly with respect to each of said bearing boxes.

5. The transport lift of claim 4, wherein said transfer track further comprises a straight portion which includes belt-driven tired wheels.

6. The transport lift of claim 5, wherein the rotation axis of a tired wheel disposed between said straight and curved portions rotatably supports a pulley for connecting a belt to an adjacent tired wheel disposed along said straight portion, and a toothed drive pinion which cooperates with an adjacent toothed inverter pinion disposed along said curved portion.

7. The transport lift of claim 1, wherein said toothed drive pinions and said toothed inverter pinions are plastic.

* * * * *